US008573096B1

(12) United States Patent
De Los Santos

(10) Patent No.: US 8,573,096 B1
(45) Date of Patent: Nov. 5, 2013

(54) NUT MEMBER STRIKE ADAPTER AND METHOD OF UTILIZING THE SAME

(75) Inventor: Elias De Los Santos, San Jose, CA (US)

(73) Assignee: Innovative Maintenance Products, LLC, San Jose, CA (US)

( * ) Notice: Subject to any disclaimer, the term of this patent is extended or adjusted under 35 U.S.C. 154(b) by 334 days.

(21) Appl. No.: 12/909,568

(22) Filed: Oct. 21, 2010

Related U.S. Application Data

(60) Provisional application No. 61/279,547, filed on Oct. 21, 2009.

(51) Int. Cl.
*B25B 19/00* (2006.01)
*B25B 13/30* (2006.01)
*B25B 13/48* (2006.01)

(52) U.S. Cl.
USPC ..... 81/463; 81/118; 81/121.1; 81/DIG. 9

(58) Field of Classification Search
USPC ..... 81/121.1, 124.2, 124.3, 124.5, 124.6, 81/DIG. 9, 90.3, 90.6, 403, 465, 466, 111, 81/118
See application file for complete search history.

(56) References Cited

U.S. PATENT DOCUMENTS

| | | | | |
|---|---|---|---|---|
| 1,550,071 | A * | 8/1925 | Guiberson | 81/90.5 |
| 2,712,766 | A * | 7/1955 | Buttle | 81/DIG. 9 |
| 2,744,431 | A * | 5/1956 | Scime | 81/124.7 |
| 5,131,300 | A * | 7/1992 | Daniel | 81/124.3 |
| 6,330,834 | B1 * | 12/2001 | Weitzman | 73/863.71 |
| 7,044,035 | B2 * | 5/2006 | Pregeant | 81/124.3 |

* cited by examiner

*Primary Examiner* — Hadi Shakeri
(74) *Attorney, Agent, or Firm* — James M. Duncan, Esq.; Klein DeNatale Goldner

(57) ABSTRACT

An adapter encircles and locks around nut members of pipe unions or nuts made up on fasteners, and engages the nut member in locking contact. The adapter has strike surfaces which allow the nut member to be tightened or loosened by a hammering means, such as a hammer, mallet or sledge hammer. Thus, in the case of a pipe union, the device temporarily converts a nut union to a hammer union. The apparatus is configured to facilitate attachment of the device in tight situations, such as attaching the device to the nut member of a pipe union on a piping manifold having closely spaced parallel pipelines.

14 Claims, 9 Drawing Sheets

NUT MEMBER STRIKE ADAPTER AND METHOD OF UTILIZING THE SAME

CROSS-REFERENCE TO RELATED APPLICATION

U.S. Provisional Application No. 61/279,547 for this invention was filed on Oct. 21, 2009 for which application this inventor claims domestic priority.

BACKGROUND OF THE INVENTION

The disclosed device relates generally to piping systems and making connections between adjacent sections of pipe, when necessary for either installation, modification, or repair. The disclosed device specifically relates to union devices for connecting adjacent sections of pipe segments.

Currently, there are two types of pipeline unions which are generally known, the nut union and the hammer union. For a typical application of a nut union utilized for industrial-sized piping systems, say 2 inches or larger in diameter, the nut style union may require the use of pipe wrenches with long handles, such as 24" through 48", in order to have sufficient leverage to apply sufficient force to either undo the connection or apply sufficient torque to prevent leakage. Such lengthy wrench handles require a large amount of open space to manipulate the handles sufficiently to apply the required leverage to the nut of the union. However, in many cases, such as valve headers, manifolds, etc, there is little room between adjacent fittings and pipes to manipulate a lengthy wrench handle, as illustrated in FIG. 1. Thus, an advantage of a hammer union is that a person can use a mallet/sledgehammer to apply a hammering impact to the nut member of the union to either tighten or loosen the threads of the nut, which may be done with minimal space from the side. However, there are other times when it is beneficial to utilize a nut union. For example, if it is desired to monitor and/or record the torque applied to the union, the known devices for determining and/or recording torque utilize a wrench or socket, thus requiring the use of a nut union.

In pipeline fields around the world, there are sections in which a large number of pipes come together at pipe junctions. Each pipe junction often has adjacent junctions immediately adjacent to it. By way of example only, the common 2" pipeline requires a pipe union fixture having a 4" nut member to accommodate the pipe threads of the pipe sections to be joined. The 4" nut member requires a pipe wrench which is typically 24-48" long in order to open the jaws wide enough to engage the 4" nut member. This creates several problems, which include (1) the field technicians have very little space to fit the required pipe wrench between the two adjacent pipe junctions to engage the pipe wrench jaws to the nut member; (2) it can be difficult to gain the best angle required to apply the requisite force to either remove the nut member or to install it; and (3) there may be insufficient room to utilize a lever arm of sufficient length to "break" the nut member free.

Thus, the technician may encounter various difficulties, including the inability to apply sufficient torque to the nut member, or the wrench must be tilted to such an angle to clear obstacles such as other pipe loops, which may result in the wrench slipping off causing injury to personnel and/or property. It is not uncommon for a technician to physically climb the pipe junction several feet off the ground, with both feet balanced on two separate 2" wide pipes 18"-36" apart in a standing position above the pipe structure. This is common practice because above the pipe structure is the only unobstructed area for the pipe wrench to swing freely, still match the nut member outer wall in any position and apply the large amount of torque required to tighten and loosen the nut member.

One known solution for this problem has been to use a different type of union utilizing bolts in a forward position. Additionally, or alternatively, the piping layout may be modified to allow more room in between the junctions to eliminate the space problem. Notwithstanding these solutions, each which has its own disadvantages, there remain thousands of junctions utilizing the nut member described above.

SUMMARY OF THE INVENTION

The present invention allows a pipe union to be tightened or loosened by either wrench or hammer-mallet, by easy application of the invention to the nut of a nut union. Thus, the invention brings together the quick and easy use of a strike surface to the current pipeline nut member style of unions used across multiple industries today. In addition, the device may be utilized for tightening other types of nuts, such as large nuts utilized on heavy equipment, etc., where access is difficult or where loosening or tightening the nut with hammer impacts is desired. For purposes of this disclosure, the term "nut member" shall be defined to include nuts which are made up onto threaded fasteners.

The apparatus generally comprises a pair of nut adapter members, where each nut adapter member comprises an inwardly facing surface. The nut adaptor members further comprise one or more outwardly extending strike members. The nut adaptor members are usually pivotally attached to one another to facilitate placement of the device around the nut member of the union. Once the nut member has been encircled by the inwardly facing surfaces, the nut adapter members are secured together at the non-pivoting side such that the inwardly facing side of each nut adapter member is retained in a facing relationship with the inwardly facing side of the other nut adapter member, with the nut member in locking engagement with each inwardly facing side. Thus installed, a hammering device such as a sledge hammer, mallet, or hammer is utilized to strike the outwardly extending strike members to either loosen the nut member or to tighten it. The two nut adapter members may be joined at the pivoting connection by a pivot pin, bolt, shaft or other connecting means. The non-pivoting side has closing means, such as a quick release locking pin or a threaded stud-nut combination where the stud, which pivots from the side of one adapter member, fits into a slot or hole on the other adapter member and secured by tightening the nut.

As suggested, embodiments of the disclosed apparatus device may be mounted to coupler nuts of pipe unions by simply wrapping the apparatus around the nut and engaging a locking pin or other apparatus to close the device. The nut adapter members may comprise two opposite "halves" which, when closed about a pivot, completely encase the outer walls of the coupler nuts. The strike members should protrude a sufficient distance away from the body of the device to allow the striking member to be utilized as a surface for impacting the device with a hammering means. Each striking member will have a side having a tightening strike surface and a side having a loosening strike surface. As the names suggest, in tightening a coupler nut, the technician would strike the tightening strike surface, and in loosening a coupler nut the technician would strike the loosening strike surface.

The width of the apparatus may, depending upon the size of the pipe, extend approximately 10-20% past the edge of the nut member. The nut adapter members may be an exact copy of the other half such that two matching units may be connected together to form the apparatus. Likewise, the inwardly facing surfaces of each nut adapter member may be mirror images of one another. However, the first nut adapter member and the second nut adapter member may each also comprise different structures which facilitate operation of the device, such as in the attachment operation.

DETAILED DESCRIPTION OF THE EMBODIMENTS

Figure 1:
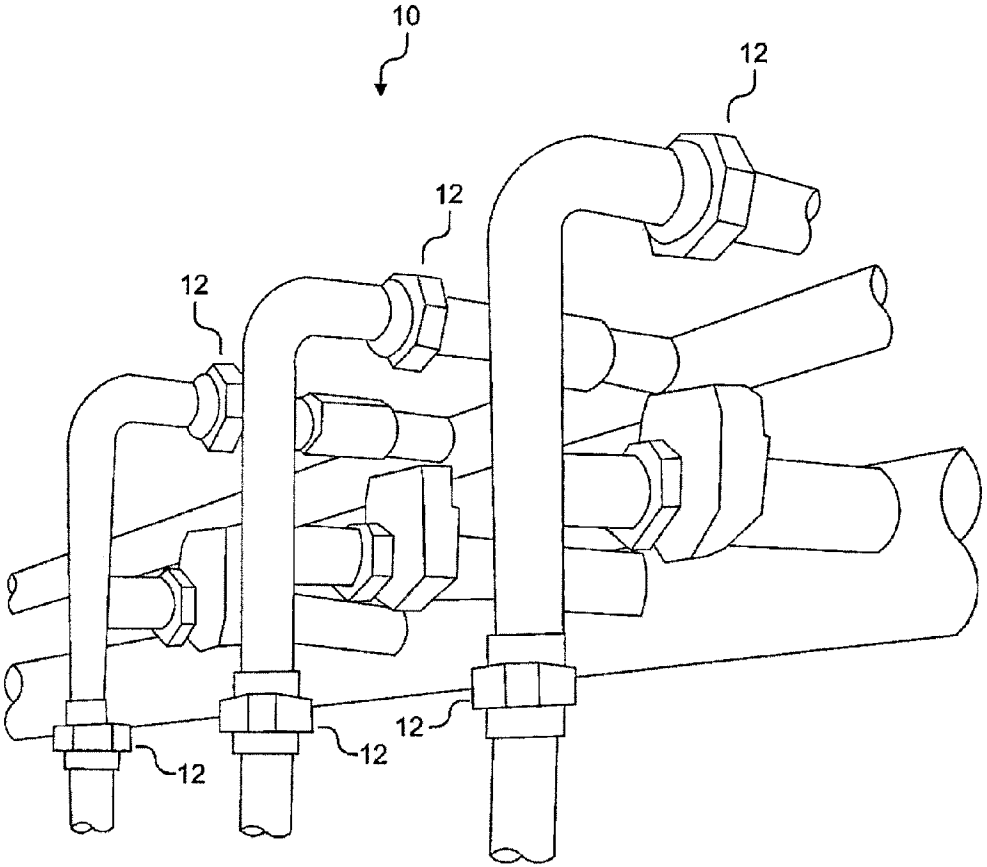
FIG. 1 (prior art)
FIG. 1 shows a pipe manifold having pipe sections are held together by nut unions, showing the close proximity of adjacent pipe junctions.
Figure 2:
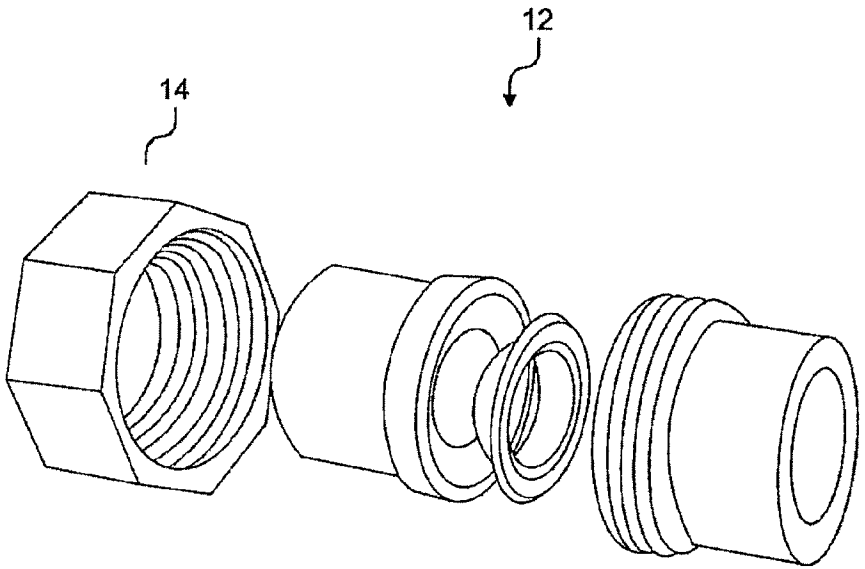
FIG. 2 (prior art)
FIG. 2 shows an embodiment of a nut union for which embodiments of the disclosed apparatus may be utilized.

Referring now to the Figures, a pipe manifold 10 having adjacent pipe sections is depicted in FIG. 1. Each pipe section is joined together with nut unions 12. FIG. 2 shows one type of pipe union 12 which might be utilized in such applications, showing the nut member 14. As can be appreciated from FIG. 1, because of the close proximity of the adjacent pipelines in pipe manifold 10, manipulating a wrench and obtaining sufficient leverage to loosen or properly tighten the nut member 14 can be problematic.

Figure 3:
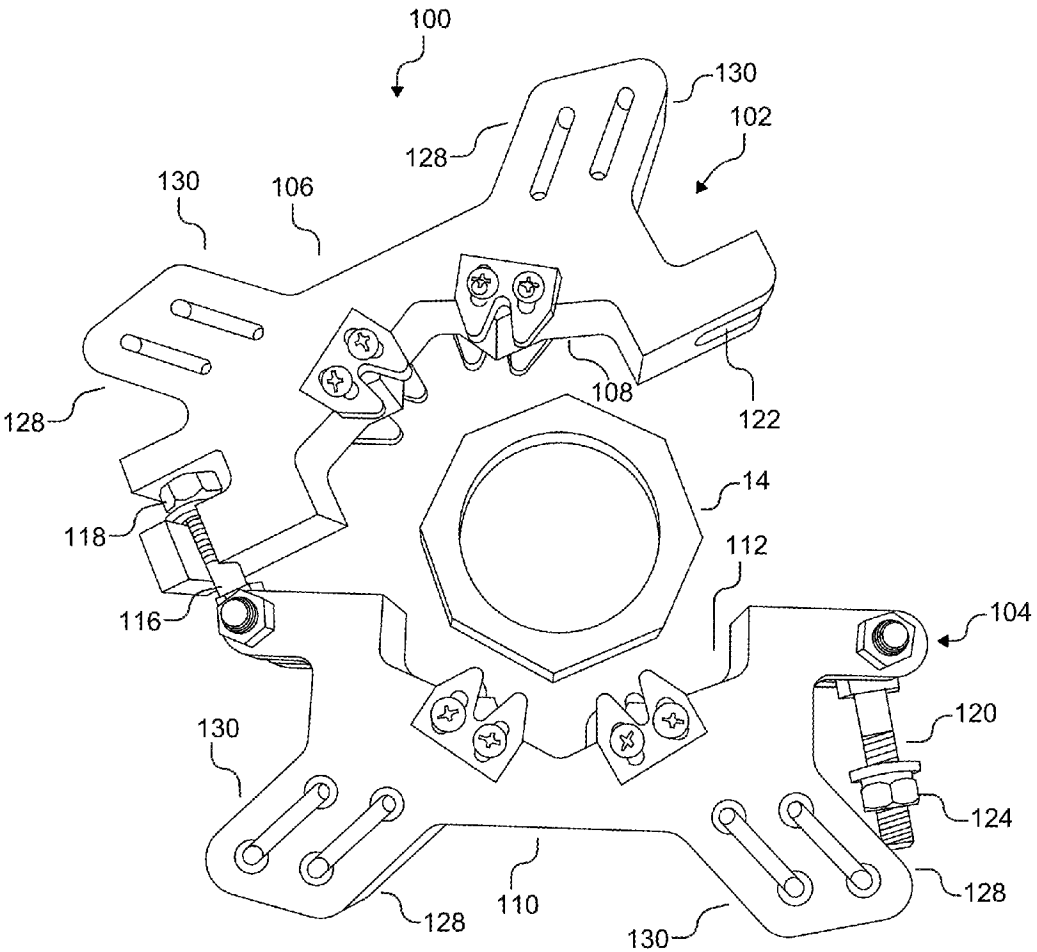
FIG. 3 shows an embodiment of the disclosed apparatus in the open position, showing how it may close around and grip a nut.

FIG. 3 shows the nut member 14 of a nut union 12 and an embodiment of the disclosed apparatus 100. It is to be appreciated that for illustration purposes only, in the following figures the nut member 14 of the nut union 12 has been removed from the pipe junction. In application the nut member will be a member of a nut union 12 such as that shown in FIG. 2 and will be installed to connection adjoining pipe sections such as those depicted in FIG. 1.

An embodiment of the apparatus 100 comprises a first nut adaptor member 102 and a second nut adapter member 104. First nut adapter member 102 has an outwardly facing side 106 and an inwardly facing side 108. Likewise, second nut adapter member 104 has a outwardly facing side 110 and an inwardly facing side 112. Nut member 14, while installed on a nut union 12, is encircled by the apparatus 100 when it is in the open position as shown in FIG. 3. The first nut adapter member 102 may be removably attached to second nut adapter member 104 with various attachment means, where the attachment means will maintain the inwardly facing side 108 of member 102 in facing relationship with the inwardly facing side 112 of member 104. When so maintained, an opening is defined by the respective inwardly facing sides 108, 112. Each of the inwardly facing sides 108, 112 comprises engagement surfaces 114 for engaging the nut member 14. As shown, the inwardly facing sides 108, 112 may be mirror images of one another.

As indicated in the figures, locking engagement of the engagement surfaces with the nut member is achieved by tightening of the attachment means which hold first nut adapter 102 and second nut adapter 104 in a closed configuration. While various attachment means may be utilized, the installation of the apparatus 100 around a nut union 12, such as that depicted in FIG. 1, is facilitated by having the first nut adapter member 102 pivotally attached to the second nut adapter member 104. As best shown in FIG. 3, the pivotal connection may comprise an eye bolt 116 pivotally attached to one of the nut adapter members 102, 104, where the threaded end of the eye bolt 116 may be attached to the opposite nut adapter member with nut 118. Once the apparatus 100 has been generally placed around the nut union 12, and specifically around the nut member 14, the device may be closed and eye bolt 120 pivoted and slipped into slot 122. Nut 118 and nut 124 may be thereafter tightened, causing the inwardly facings sides 108, 112 to come into locking engagement with the nut member 14. Fasteners, such as eye bolts 116, 120 may utilize fastener retention members 140 which are located on the outwardly facing sides 106, 110 of the first nut adapter member 102 and the second nut adapter member 104. As shown in the figures, various configurations of fastener retention members 140 may be utilized, having slots, holes, nut capture structures, and other configurations which facilitate installation and removal of the device.

It is to be appreciated that a variety of different attachments may be utilized to allow the members 102, 104 to pivot with respect to one another, closed, and tightened together. The two nut adapter members 102, 104 may be joined together at pivoting connection, such as that provided by eye bolt 116, or by a pivot pin, bolt, shaft or other connecting means. The non-pivoting side has closing means, such as eye bolt 102, or by a quick release locking pin, clamping device or other means of securing the apparatus in a closed position.

Figure 4:
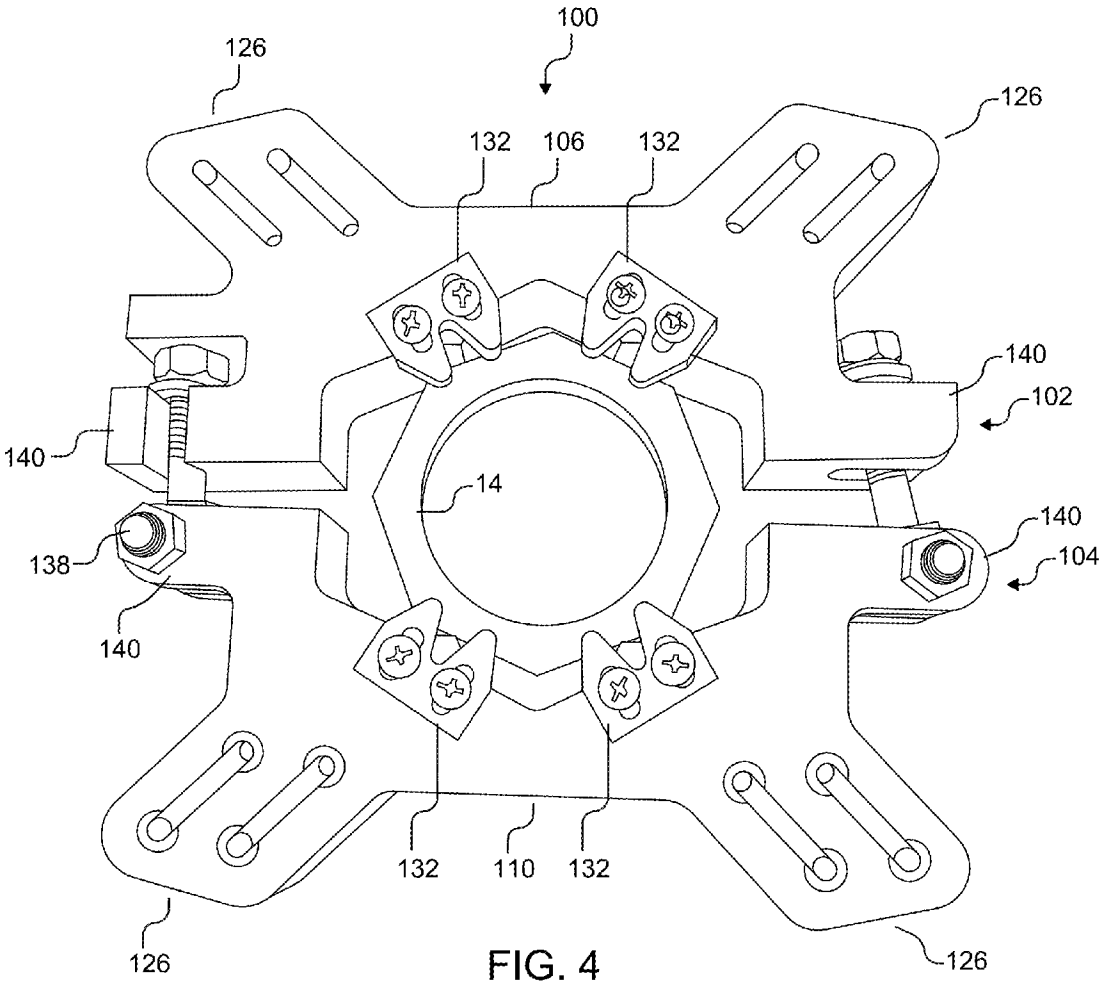
FIG. 4 shows the embodiment of FIG. 3 with the apparatus in the closed position around a nut.
Figure 5:
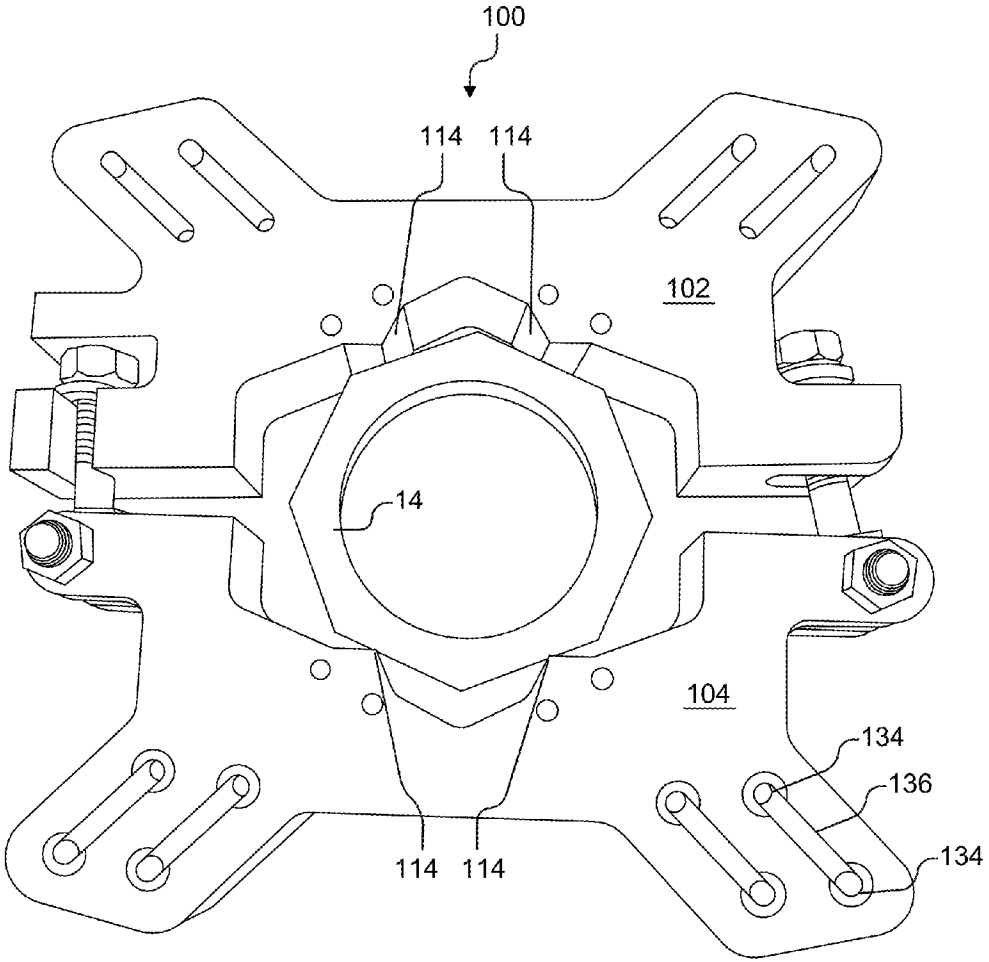
FIG. 5 shows an embodiment of the apparatus with the nut support members removed.

FIG. 4 shows an embodiment of the apparatus 100 tightened around a nut member 14. Once the apparatus has been tightened into locking engagement with the nut member 14, it is ready to be used for either loosening or tightening the nut member. A hammering means, such as a sledge hammer, mallet, or other hammering device is utilized to strike one of the strike members 126 which radiate outwardly from the outwardly facing sides 106, 110 of the apparatus 100. Each strike member 126 comprises a tightening strike surface 128 and a loosening strike surface 130. As suggested by the name, the tightening strike surface 128 will normally be on the side of the strike member 126 where a hammer blow will cause the apparatus 100, and thus the nut member 14, to rotate clockwise. Similarly, the loosening strike surface 130 will be on the side of the strike member 126 where a hammer blow will cause the apparatus 100 and nut member 14 to rotate counterclockwise. Of course, for nut members 14 having left-handed threads, the opposite sides of the strike members will be utilized for tightening and loosening the nut member.

The apparatus 100 may have various means which allow the device to be supported on the nut member before the device is completely installed by fully attaching the first nut adapter member 102 to the second nut adapter member 104. It is to be appreciated that because the apparatus 100 will typically constructed from heavy and durable materials, such various metals, alloys, carbon steel, that the apparatus will usually have a significant weight. If a single person is installing the apparatus on a nut member 14 having a horizontal orientation, securing the device to the nut member can be complicated. However, with the support means, one of the nut adapter members 102, 104 can be "hung" from the nut member 14 such that the technician may use both hands to secure the other nut adapter member to the first and latch the eye bolt 120 or other closing device. One form of support means are removable clips 132, which are fastened to the nut adapter members 102, 104. As can be seen in FIG. 4, the removable clips grasp the sides of nut member 14.

If used in pipeline applications, the apparatus 100 may be used to separate a union 12 on a pipeline through which oil, solvent, sewage, or other chemicals may be flowing. When the nut member is sufficiently loosened, the contents of the pipeline will spill out, covering various items, including the apparatus 100. If certain substances, such as oil, or spilled over the device, the strike members 126 may become slippery, and require washing to provide a non-slippery striking surface. To facilitate cleaning of the apparatus 100, one or more of the strike members 126 may have means of allowing liquids to drain from the strike members, particularly when the apparatus is in a horizontal orientation. Holes through the strike members 126 will allow such drainage. The drain means may comprise a pair of apertures 134 which extend through the strike member 126. The two apertures may be connected by a groove 136 in the outside surface of the strike member which extends between the two apertures. As shown in the figures, each strike member 126 may have multiple drains.

Figure 6:
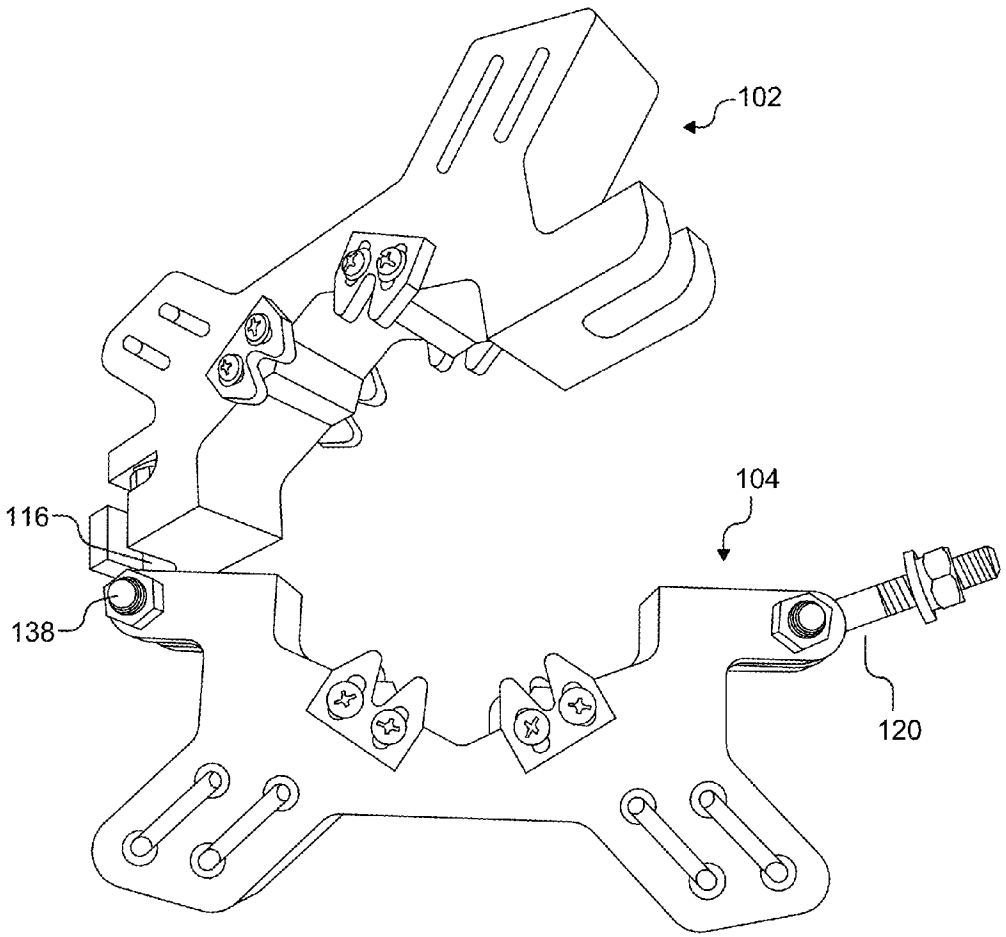
FIG. 6 shows how embodiments of the apparatus may pivot in a different plane than the plane of the nut.

FIG. 6 shows how an embodiment of the apparatus 100 may pivot in two different planes. First, the apparatus may pivot open, in a jaw like fashion, where it pivots about a fastener 138 made up into the eye of eye bolt 116. Other pivoting means, such as pins or hinges may also be utilized for providing this pivoting action. When pivoting about fastener 138, the apparatus 100 is pivoting in the same plane as the nut member 14. However, as shown in FIG. 6, nut adapter member 102, or nut adapter member 104, may also pivot about eye bolt 116, which allows the member to pivot in a different plane than the plane of the nut member 14. This feature allows the apparatus 100 to be manipulated as necessary to fit around various obstacles in order to fit it around the nut member 14, which may be necessary in a manifold situation where the different pipelines are very close together.

Figure 7:
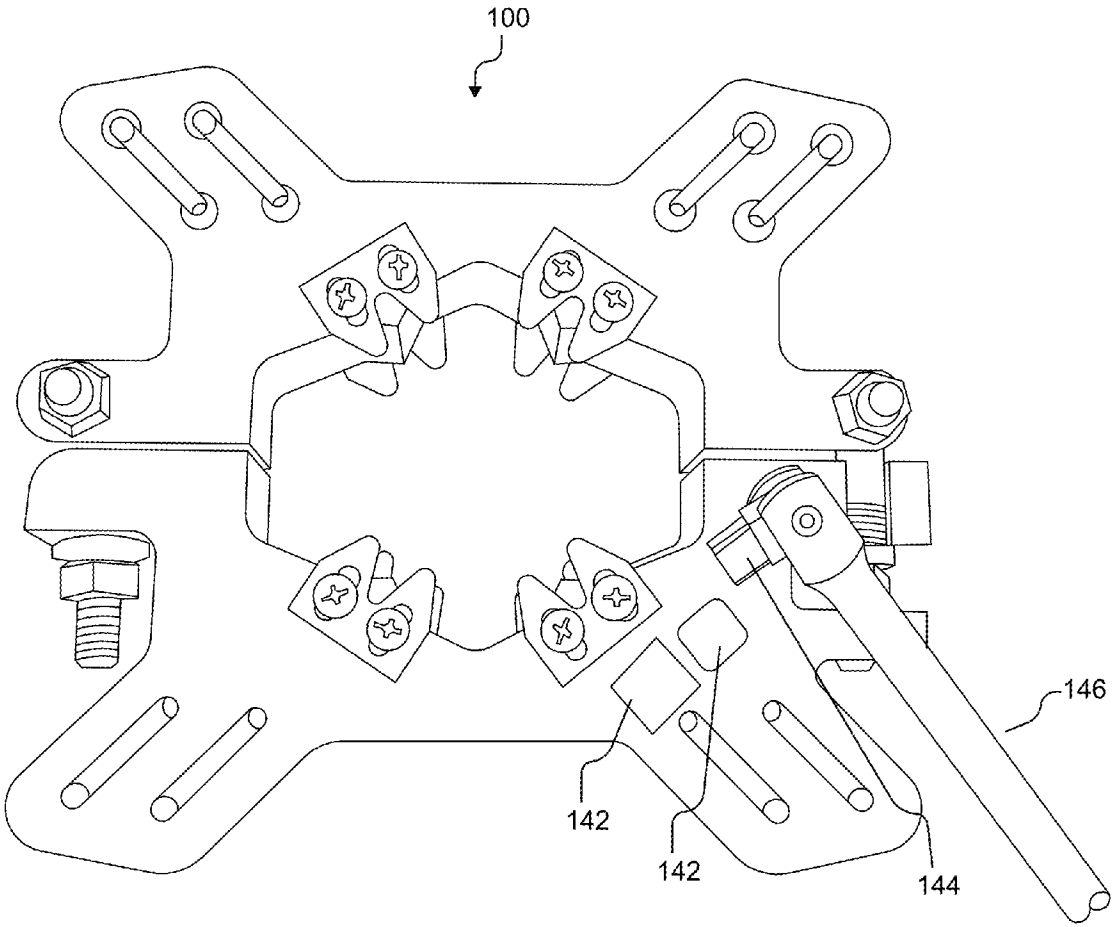
FIG. 7 shows an embodiment of the apparatus which comprises means for directly attaching a breaker bar to the device.

FIG. 7 shows how an embodiment of the apparatus 100 may comprise means for attaching a lever arm to the device when it becomes necessary to apply additional leverage to either tighten or loosen the nut member 14. For example, a lever bar may be inserted in one of the slots of the apparatus. Alternatively, the apparatus 100 may comprise one or more openings 142 which partially penetrate the device. When the apparatus 100 includes openings 142, a drive head 144 may be inserted into the openings to allow the attachment of breaker bar 146.

Figure 8:
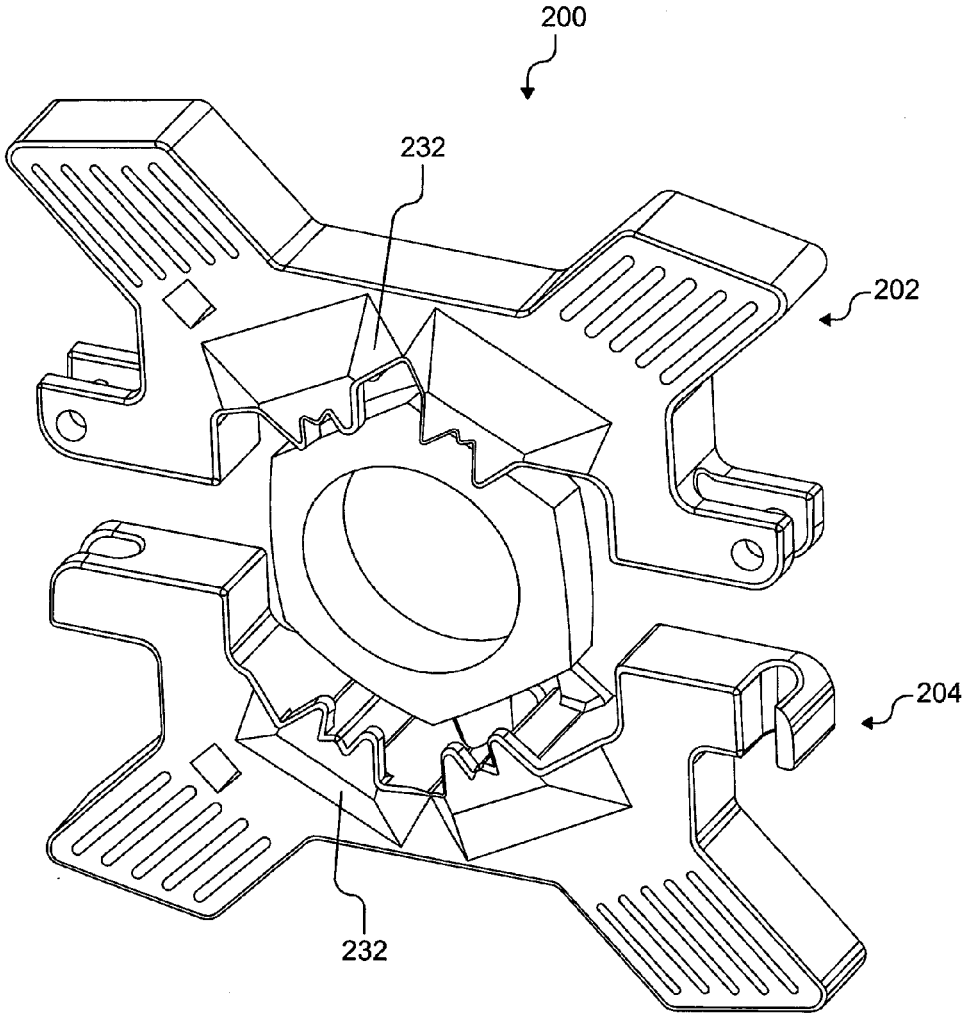
FIG. 8 shows an embodiment of the apparatus with integral nut support members.

FIG. 8 shows an embodiment of the apparatus 200 having integrated "clips" 232 for retaining the apparatus to a nut member 14.

Figure 9:
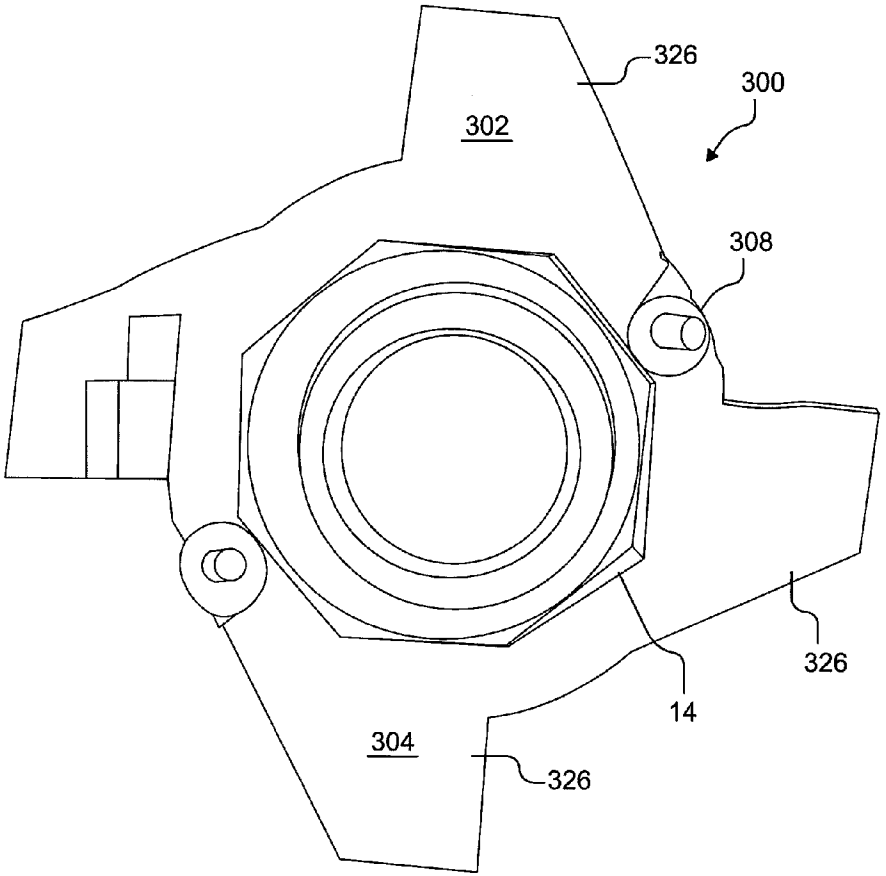
FIG. 9 shows an embodiment of the apparatus in which the two nut engagement members are mirror images of each other.

In some embodiments, such as the apparatus 300 shown in FIG. 9, the first nut adapter member 302 and the second nut adapter member 304 may be identical, simplifying the manufacturing process. In this embodiment, the first nut member 302 is pivotally connected to second nut adapter member 304 with a hinge pin 306. A quick release pin 308 is utilized to lock the device about the nut member 14. As with the other disclosed embodiments, this embodiment comprises radially extending strike member 326.

Embodiments of the disclosed apparatus may be used according to the following steps:

In mounting the adapter to a union nut 14, the jaws (i.e., nut adapter members) are swung to an open position so that it will fit around the nut 14 with one of the strike surfaces facing a clockwise direction, assuming right handed threads on the nut. The jaws are then swung to a closed position completely encircling the nut. The pivoting eye bolt 120, locking pin or other closing means is activated to prevent the unit from opening.

To loosen a union nut, a user strikes the striking member in a counter-clockwise direction with an impact device, such as a hammer or mallet providing enough force to break the nut seal. To tighten a union nut, a user will mount the apparatus with the strike arms facing a clockwise direction and use an impact device to apply sufficient force to seal the nut. A user may remove the device by removing the locking means, open the jaw members apart, thus allowing the unit to clear the nut. If desired, once the device is removed, a user may employ a torque measuring means to insure the nut has been adequately torqued. Thus the present device allows the user the advantages of both a hammer union and a nut union.

It is to be appreciated that while various pipe dimensions have been discussed above, embodiments of the apparatus may be utilized for both smaller and larger pipe sizes.

While the above is a description of various embodiments of the present invention, further modifications may be employed without departing from the spirit and scope of the present invention. Thus the scope of the invention should not be limited according to these factors, but according to the following appended claims.

What is claimed is:

1. A device for facilitating the loosening or tightening of a nut member, the device comprising:

a first nut adaptor member and a second nut adapter member, each nut adapter member comprising an outwardly facing side and an inwardly facing side;

means for attaching the first nut adapter member to the second nut adapter member with the inwardly facing side of the first nut adapter member in facing relationship with the inwardly facing side of the second nut adapter member, wherein an opening is defined by the respective inwardly facing sides when the first nut adapter member is attached to the second nut adapter member and the opening comprises inwardly facing engagement surfaces for engaging the nut member;

the outwardly facing side of the first nut adapter member comprising a strike member radiating outwardly, the strike member comprising a side having a tightening strike surface and a side having a loosening strike surface;

wherein the first nut adapter member may pivot with respect to the second nut adapter member before the first nut adapter member is fully attached to the second nut adapter member;

wherein a plane is defined by the nut member, wherein the plane is parallel to the opening of the nut member, and the device may pivot in the same plane as the plane defined by the nut member or, alternatively, the first nut adapter member may pivot in a different plane than the plane defined by the nut member while the second adapter member remains in the plane defined by the nut member.

2. The device of claim 1 wherein the inwardly facing sides of the first nut adapter member and the second nut adapter member are mirror images of one another.

3. The device of claim 1 wherein the outwardly facing sides of the first adapter member and the second adapter member each comprise outwardly facing fastener retention members.

4. The device of claim 3 wherein the means for connecting the first nut adapter member to the second nut adapter member comprises a threaded fastener extending between each of the outwardly facing fastener retention members.

5. The device of claim 4 wherein the threaded fasteners comprise a first end pivotally attached to the fastener retention members of the first nut adapter member and a second end which engages the fastener retention members of the second nut adapter member.

6. The device of claim 5 wherein the second ends of the threaded fasteners are attached to the fastener retention members of the second nut adapter member by nuts.

7. The device of claim 1 further comprising means for supportively hanging the device from the nut member before the first nut adapter member is fully attached to 0 the second nut adapter member.

8. The device of claim 1 wherein the first nut adapter member and the second nut adapter member each comprise two strike members.

9. A device for facilitating the loosening or tightening of a nut member the device comprising:

a first nut adaptor member comprising a pair of outwardly extending strike members, a pair of fastener retention members, and an inwardly facing side, the inwardly facing side comprising engagement surfaces for engaging two sides of the nut member;

a second nut adaptor member pivotally attached to the first nut adapter member, the second nut adaptor member comprising a pair of outwardly extending strike members, a pair of fastener retention members, and an inwardly facing side, the inwardly facing side comprising engagement surfaces for engaging two sides of the nut member; and means for securing the first nut adapter member to the second nut adapter member in a fixed position with respect to one another such that the inwardly facing side of the first nut adapter member is retained in a facing relationship with the inwardly facing side of the second nut adapter member, each inwardly facing side in locking engagement with the nut member; and at least one pair of opposite facing clips attached to the first nut adapter member, the opposite facing clips oriented toward the inwardly facing side, the opposite facing clips defining an opening for receiving a side of the nut member.

10. The device of claim 9 wherein the inwardly facing sides of the first nut adapter member and the second nut adapter member are mirror images of one another.

11. The device of claim 9 wherein one or more of the strike members comprises drain means extending through the strike member.

12. The device of claim 11 wherein the drain means comprises a pair of apertures extending through the strike member, where a groove in the outside surface of the strike member extends between the two apertures.

13. The device of claim 9 further comprising means for attaching a lever arm to the device.

14. The device of claim 13 wherein the means for attaching a lever arm to the device comprises an opening for inserting a drive head of a breaker bar.

* * * * *